US007802693B2

(12) United States Patent
Kuhn

(10) Patent No.: US 7,802,693 B2
(45) Date of Patent: Sep. 28, 2010

(54) FREE MOVING SYSTEM FOR STABLE, MANUAL SUPPORT FOOD AND DRINK ITEMS

(75) Inventor: Brian P. Kuhn, Superior, CO (US)

(73) Assignee: Superior Devices, LLC, Superior, CO (US)

( * ) Notice: Subject to any disclaimer, the term of this patent is extended or adjusted under 35 U.S.C. 154(b) by 1247 days.

(21) Appl. No.: 10/536,177

(22) PCT Filed: Nov. 25, 2003

(86) PCT No.: PCT/US03/37889

§ 371 (c)(1),
(2), (4) Date: May 23, 2005

(87) PCT Pub. No.: WO2004/047593

PCT Pub. Date: Jun. 10, 2004

(65) Prior Publication Data

US 2006/0049194 A1 Mar. 9, 2006

Related U.S. Application Data

(60) Provisional application No. 60/429,775, filed on Nov. 26, 2002.

(51) Int. Cl.
*B65D 25/04* (2006.01)

(52) U.S. Cl. ..... 220/575; 220/23.8

(58) Field of Classification Search ..... 220/574, 220/23.8, 575, 556, 737, 23.86
See application file for complete search history.

(56) References Cited

U.S. PATENT DOCUMENTS

| | | | |
|---|---|---|---|
| 28,693 | A | 6/1860 | Shirley |
| 421,264 | A | 2/1890 | Gibbons |
| 774,479 | A | 11/1904 | Lange |
| 817,148 | A | 4/1906 | Allen |
| D87,682 | S | 8/1932 | Porter |
| 1,943,698 | A | 1/1934 | Schurmann |
| 1,949,285 | A | 2/1934 | Porter |

(Continued)

FOREIGN PATENT DOCUMENTS

| | | |
|---|---|---|
| FR | 2239970 | 3/1975 |

(Continued)

OTHER PUBLICATIONS

U.S. Appl. No. 60/429,775, Kuhn.

(Continued)

*Primary Examiner*—Stephen Castellano
(74) *Attorney, Agent, or Firm*—Santangelo Law Offices, P.C.

(57) ABSTRACT

The invention relates to a system for holding food item(s) and a beverage container(s) with one hand. Stable handling of an integral somewhat planar support (1) with one hand may be enabled by an elliptical negative space (26) where the operator inserts either thumb to comfortably rest the device with equal weight perhaps on the first metacarpal bone, the phalanges, and radius of the same hand. An integral somewhat planar support may include a containment structure (4) having a noncircular yawning void (5) which may allow for retention of a variety of beverage containers and perhaps even a pedestal mounted object. Regions (14) may be provided for the retention of food items on an integral somewhat planar support.

30 Claims, 8 Drawing Sheets

U.S. PATENT DOCUMENTS 2,056,943 A 10/1936 Lehman
D104,363 S 5/1937 Barth
2,101,401 A 12/1937 Leppke
2,107,023 A 2/1938 Bertsch
2,107,381 A 2/1938 Leppke
2,110,542 A 3/1938 Allen
2,174,586 A 10/1939 Leppke
2,240,020 A 4/1941 Raiser
D130,502 S 11/1941 King
D130,770 S 12/1941 Morgan
2,295,860 A * 9/1942 Oliver ..... 294/172
2,352,684 A 7/1944 Braddock
D144,296 S 4/1946 King
2,411,864 A 12/1946 Birkin
2,427,697 A 9/1947 Weidler
D159,454 S 7/1950 Waltman
D160,688 S 10/1950 Brock
2,561,022 A 7/1951 Jones
2,602,310 A 7/1952 Hansen
2,719,414 A 10/1955 Davis
2,878,932 A 3/1959 Martire, Jr.
D185,911 S 8/1959 Chadbourne
2,916,180 A 12/1959 Alger
2,920,804 A 1/1960 Minton
3,039,616 A 6/1962 Proffit
D194,114 S 11/1962 Graham
3,094,264 A 6/1963 Petrone
3,115,251 A 12/1963 Farrell
D197,618 S 3/1964 Milbourne
3,381,825 A 5/1968 Bessett
D211,532 S 6/1968 Ashton
3,401,858 A 9/1968 White et al.
D214,459 S 6/1969 Stageberg
3,498,470 A 3/1970 Thomas
3,504,832 A 4/1970 Corvetti
D221,883 S 9/1971 Cash
D227,851 S 7/1973 Nowland et al.
3,768,710 A 10/1973 Eggers
3,881,674 A 5/1975 Greene, III
D235,500 S 6/1975 Alexander
3,941,286 A 3/1976 Perkinson
3,942,671 A 3/1976 Florian
3,955,672 A 5/1976 Brundage
D251,102 S 2/1979 Box
4,204,598 A 5/1980 Adams
D257,310 S 10/1980 Cosmopulos
D261,588 S 11/1981 Fichte
D270,324 S 8/1983 French
D272,117 S 1/1984 Lyon et al.
D272,218 S 1/1984 Daenen et al.
D272,506 S 2/1984 Steiner
4,460,085 A * 7/1984 Jantzen ..... 206/349
4,461,396 A 7/1984 Harper
D278,198 S 4/1985 Harper
4,516,685 A 5/1985 French
D281,565 S 12/1985 Stourton et al.
D281,849 S 12/1985 Cantor
4,607,758 A 8/1986 Stevens
D285,999 S 10/1986 Ludwick et al.
D286,250 S 10/1986 Prescott
D292,161 S 10/1987 Spolter et al.
4,744,597 A 5/1988 Bauman et al.
D297,799 S 9/1988 Hammer
4,785,959 A 11/1988 Kleiner
4,823,958 A 4/1989 Mahmud
4,860,895 A 8/1989 Iaslovits
D303,194 S 9/1989 Darby et al.
4,867,331 A 9/1989 Task
4,871,082 A 10/1989 Jarosky
D305,304 S 1/1990 McCaleb
D307,529 S 5/1990 Baetens
4,936,481 A 6/1990 Rosenfeld
4,938,373 A 7/1990 McKee
4,961,555 A 10/1990 Egan, Jr.
4,966,297 A 10/1990 Doty
5,010,826 A 4/1991 Kudlac
5,029,720 A 7/1991 Bridges
5,058,737 A 10/1991 Patterson et al.
5,060,820 A 10/1991 Boerner
5,062,674 A 11/1991 Magee
D322,197 S 12/1991 Sherlin
5,085,391 A 2/1992 Berger et al.
5,110,170 A 5/1992 Boatwright
5,111,960 A 5/1992 Zilliox
5,114,038 A 5/1992 Laumann geb. Quensen
D331,860 S 12/1992 Stanfield
5,170,908 A 12/1992 Austin
D332,552 S 1/1993 Lynch
5,176,283 A 1/1993 Patterson et al.
5,184,750 A 2/1993 Moller
5,207,743 A 5/1993 Costarella et al.
D338,374 S 8/1993 Jacobson
5,234,125 A 8/1993 Roberts
5,249,700 A 10/1993 Dumke
5,259,528 A 11/1993 Pace et al.
5,292,028 A 3/1994 Patterson et al.
5,301,871 A 4/1994 Gross et al.
RE34,703 E 8/1994 Zilliox
D349,212 S 8/1994 Lynch
5,346,070 A 9/1994 McSpadden
D351,085 S 10/1994 Schmidt
5,353,952 A 10/1994 Donche
5,361,932 A 11/1994 Friedrich
5,397,089 A 3/1995 Kataoka
5,419,455 A 5/1995 Russeau
5,421,459 A 6/1995 Mazzotti
5,429,231 A 7/1995 McSpadden
5,441,164 A 8/1995 Beck et al.
D363,644 S 10/1995 Wyatt et al.
D366,395 S 1/1996 Wyatt et al.
5,497,885 A 3/1996 Sussman
D368,627 S 4/1996 McSpadden
D373,052 S 8/1996 Di Biase
5,542,577 A 8/1996 Friedrich
5,593,062 A 1/1997 Martin
5,598,944 A 2/1997 Aragona
5,624,052 A 4/1997 Caldi
D386,048 S 11/1997 Bebawey
D388,661 S 1/1998 Vignau et al.
D389,020 S 1/1998 LaJoie
D392,156 S 3/1998 Michael
5,732,847 A 3/1998 Caldi
D397,911 S 9/1998 Waldmann
5,853,104 A 12/1998 Rathjen
D410,820 S 6/1999 Lofrano
5,947,011 A * 9/1999 Xu ..... 99/357
5,950,856 A 9/1999 Cinque
5,984,136 A 11/1999 Mason
D418,018 S 12/1999 Winsted
6,021,914 A * 2/2000 Schmidt ..... 220/574
6,062,418 A 5/2000 Rathjen
6,129,235 A * 10/2000 Creske ..... 220/575
6,138,860 A 10/2000 Comeaux
6,149,027 A 11/2000 Rathjen
D434,945 S 12/2000 Godwin
6,213,529 B1 * 4/2001 Kurcz et al. ..... 294/143
2001/0032791 A1 * 10/2001 Hudson ..... 206/217

FOREIGN PATENT DOCUMENTS

GB 2367233 4/2002
WO WO 92/20586 11/1992
WO WO 02/07572 A1 1/2002

WO WO 2004/047593 A1 6/2004

OTHER PUBLICATIONS http://www.drdynamics.com/products/platecaddy/ , Feb. 17, 2004, (p. 1 of 1).
http://www.aecatering.com/database/foodservice , Feb. 17, 2004, (p. 1 of 1).
http://wwwezholdproducts.com/cocktailplate.htm, Aug. 24, 2004, (2 pages).
The Find.com/kitchen/info-cocktail-plate, 4 pages Dec. 2, 2008.
Pottery Barn, Springwood Mingling Plate, 1 page Oct. 22, 2007.
Plastic Plates-Cocktail Plastic Plates, 4-plasticplates.com, 2 pages Dec. 2, 2008.
Fine China, Cocktail Plate with Wine Holder, nor-valevents.com 1 page Dec. 2, 2008.
Cocktail Plates, KlinQ.com, www.klinq.com/browse.asp?mc=1&sc=159&ssc=326, 3 pages, Dec. 2, 2008.
At Home with Kim Vallee, blog.kimvallee.com, Socialize with ease at cocktail parties with one free hand plates, 8 pages, Nov. 21, 2008.
Goodiesblog.com:Martens—wine/Cocktail Plate—the search for significant items, 2 pages Dec. 2, 2008.
EZHold Cocktail Plate, ezholdproducts.com/cocktailplate.htm, 2 pages Dec. 2, 2008.
Cocktail Plates and Accessories from PartySales.com, Partysales.com/cocktailplates.htm, 2 pages, Dec. 19, 2008.
Ironwood Gourmet, Wood cocktail Plates, Kitchen Emporium.com, Dec. 2, 2008.
Instawares, Restaurant Supply SuperStore, Triangles Black Cocktail Plate with Glass Holder, Dec. 2, 2008.

* cited by examiner

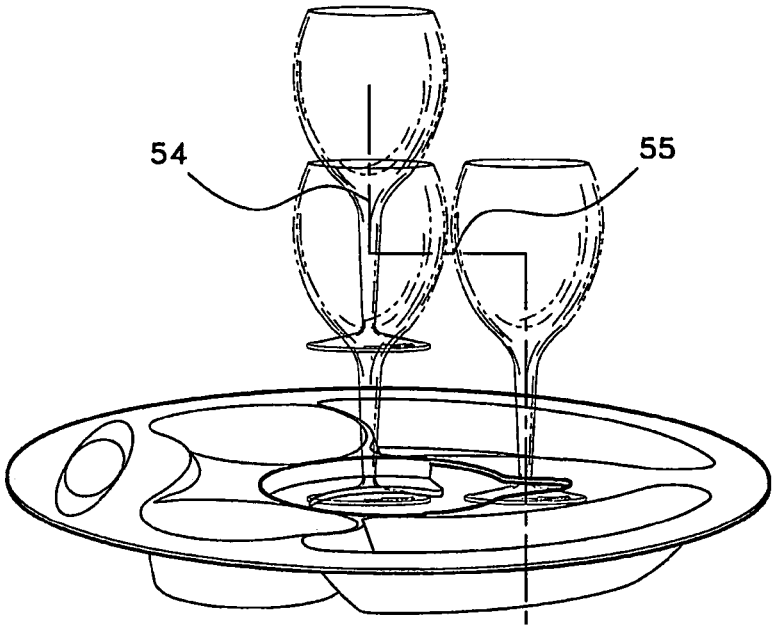
Fig. 6A
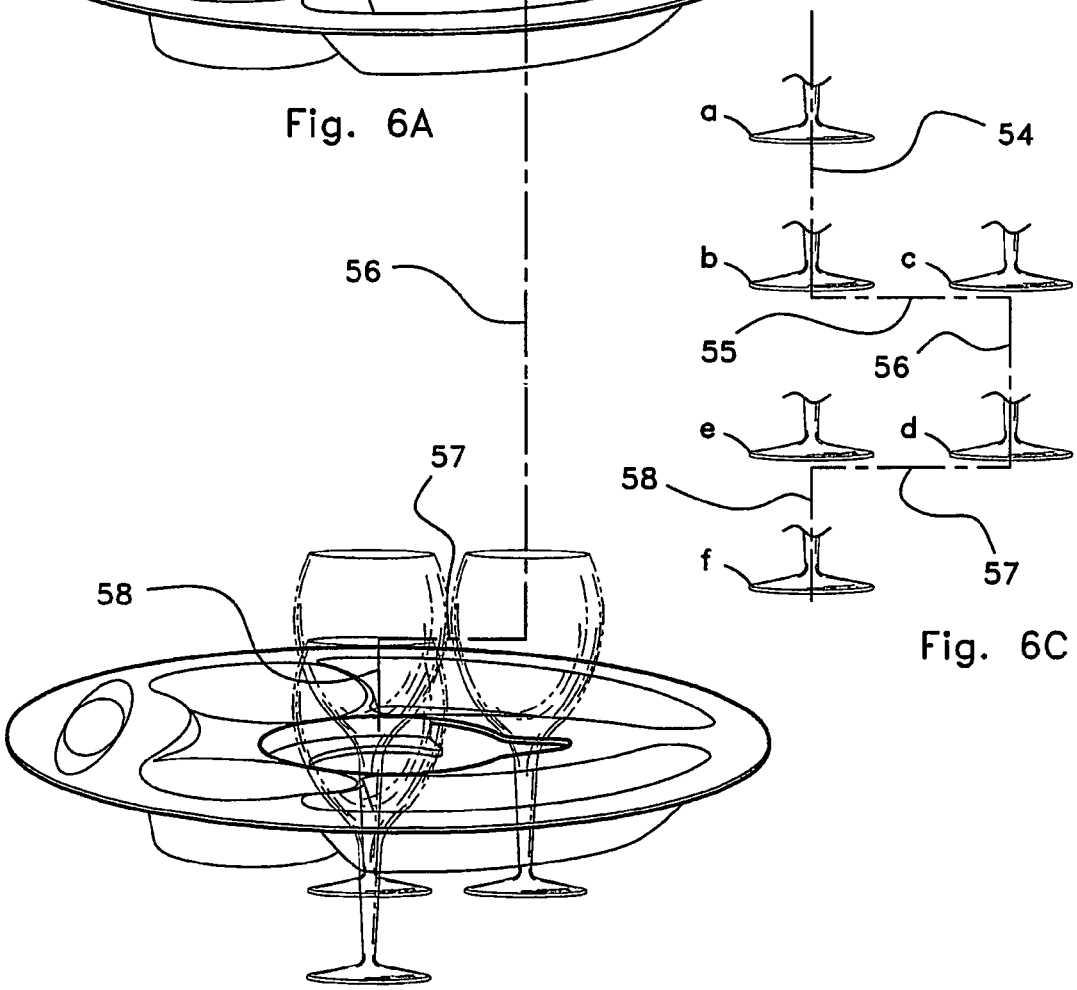
Fig. 6C
Fig. 6B

FREE MOVING SYSTEM FOR STABLE, MANUAL SUPPORT FOOD AND DRINK ITEMS

I. CROSS-REFERENCES TO RELATED APPLICATIONS

This application is the United States National Stage of International Application No. PCT/US2003/037889, filed 25 Nov. 2003 which claims the benefit of U.S. Provisional Application No. 60/429,775, filed 26 Nov. 2002, each hereby incorporated by reference. All priority cases are hereby incorporated by reference herein.

II. TECHNICAL FIELD

Generally, this invention relates to a system for retaining an object or container of varying shapes, such as a cylindrical object, or a pedestal mounted object in a device with one hand, and techniques of manual operation, while retaining secondary items on the same horizontal plane. Specifically, the invention focuses upon techniques for the hospitality industry where handling of beverage and food items is prevalent. The invention relates to plates and other devices with characteristics which enable the operator or user to comfortably hold items, including but not limited to a beverage container and food items, with one hand.

III. BACKGROUND

In one embodiment, this invention relates generally to a planar support with numerous contours, which enable the centralized retention of an object of varying shapes and sizes, such as a cylindrical object, or a pedestal mounted object, and concave region(s) for the retention of secondary objects. The present invention also focuses upon techniques for the hospitality and entertainment industry where the distribution and manual balancing of numerous food and beverage items is fairly common.

Standing social gatherings where food and beverages are consumed can prove to be awkward for the participants. An attendee of such a function is often posed with the dilemma of being unable to freely perform a variety of hand movements while holding a food plate in one hand and a beverage container in the other. In addition to greeting another attendee with a handshake, the simple process of alternatively consuming food and beverages can pose a dilemma. Typically, the participants chose one or a combination of three outcomes: 1) refrain from one of the consumption functions to exclusively engage in the other, eating or drinking; 2) precariously hold the plate and beverage with one hand to consume a food item with the other hand with significant risk of dropping or spilling; or 3) disengage from socializing to a stable surface to rest the plate and or beverage container, freeing one or both hands to consume food and beverage.

Many hosts of standing social gatherings largely ignore these described challenges. The dilemma of not being able to comfortably consume even moderate quantities of food and beverage in such a setting can be a source of frustration for the attendees and unintended negative outcomes for the host. Non-desirable situations include, but are not limited to: dropping of food and spilling of beverages; the unpleasant gastronomic experience of exclusively consuming food or beverage; large quantities of food and beverage not being consumed and ultimately disposed; and limited social interaction due to attendees struggling with the manual challenges of food and beverage consumption. Numerous attempts have been made to solve this age-old dilemma, however, design limitations have hindered widespread acceptance or significant commercial success of existing devices.

The retention of a cylindrical shaped beverage container is relatively simple with the use of a round recessed region; however, the additional accommodation of stemware may pose a greater challenge. While other items may have round retention areas, none appear to have arranged a series of decreasing sizes for the accommodation of varying sizes of beverage containers as disclosed here. Other devices appear to have attempted to retain stemware with similar outcomes; virtually all result in an open region on the outer perimeter of the invention. In many designs, the open region on the outer perimeter may weaken the structural integrity of the device, may heighten the probability of the seated stemware falling out of the retention area, and may place strain on the hand and wrist of the operator due to the weight placement on the perimeter. Further, numerous devices were relatively sufficient at retaining food and beverage containers, however, their tall profiles made them comparatively cumbersome and space-inefficient for storage and commercial shipment.

Strain and lack of stability may be associated with traditionally grasping a horizontal object on the perimeter or resting it on the palm of a hand, which may be held face up. Yet, the process of making a device easier to grasp has been attempted. A thumb hole has been a recurring theme as evidenced by U.S. Pat. No. D 194,114 to Graham, U.S. Pat. No. D 278,198 to Harper, U.S. Pat. No. 2,107,023 to Bertsch, U.S. Pat. No. 2,295,860 to Oliver, U.S. Pat. No. 3,094,264 to Petrone, U.S. Pat. No. 3,401,858 to White et al, U.S. Pat. No. 4,461,396 to Harper, U.S. Pat. No. 5,114,038 to Laumann geb. Quensen, and PCT Pub. No. WO92120586. With each of these designs, it may be intended for the operator to pass a portion of a thumb through the invention. From one perspective, the shape and scale of these thumbholes do not adequately enable significant passage of the thumb beyond the metacarpophalangeal (MCP) joint. Ergonomically, these devices lack a degree of human comfort as well as stability.

U.S. Pat. No. D 194,114 to Graham, U.S. Pat. No. D 227,851 to Nowland, U.S. Pat. No. D 292,161 to Spolter et al, U.S. Pat. No. D 322,197 to Sherlin, U.S. Pat. No. 421,264 to Gibbons, U.S. Pat. No. 2,107,023 to Bertsch, U.S. Pat. No. 3,401,858 to White et al, U.S. Pat. No. 3,504,832 to Corvetti, U.S. Pat. No. 3,941,286 to Perkinson, U.S. Pat. No. 4,461,396 to Harper, U.S. Pat. No. 4,607,758 to Stevens, U.S. Pat. No. 4,744,597 to Bauman et al, U.S. Pat. No. 4,785,959 to Kleiner, U.S. Pat. No. 4,966,297 to Doty, U.S. Pat. No. 5,234,125 to Roberts, U.S. Pat. No. 5,361,932 to Friedrich, U.S. Pat. No. 5,397,089 to Kataoka, U.S. Pat. No. 5,542,577 to Friedrich, U.S. Pat. Nos. 5,950,856 and 6,138,860 to Comeaux are designs which can accommodate a cup as well as stemware, however, none of these designs allow for stemware to rest in the center of the device as in the present invention. The placement of stemware in any position other than the center of a device may even contribute to a lack of balance in some designs.

Caldi's U.S. Pat. Nos. 5,624,052 and 5,732,847 accommodate a cup as well as stemware and may even position stemware in the center of the device. Caldi's design may be suboptimal from at least one of the present perspectives perhaps because it includes a broken outer circular perimeter. With a broken circular perimeter, and relatively high profile, the device can prove to be bulky, cumbersome and structurally weak in some uses.

U.S. Pat. No. D 292,161 to Spolter et al, U.S. Pat. No. 421,264 to Gibbons, U.S. Pat. No. 774,479 to Lange, U.S. Pat. No. 817,148 to Allen, U.S. Pat. No. 2,107,023 to Bertsch, U.S. Pat. No. 3,401,858 to White et al, U.S. Pat. No. 3,504,832 to Corvetti, U.S. Pat. No. 3,881,674 to Greene, U.S. Pat. No. 3,941,286 to Perkinson, U.S. Pat. No. 4,204,598 to Adams, U.S. Pat. No. 4,461,396 to Harper, U.S. Pat. No. 4,744,597 to Bauman et al, U.S. Pat. No. 4,785,959 to Kleiner, U.S. Pat. No. 4,860,895 to Iaslovits, U.S. Pat. No. 4,966,297 to Doty and U.S. Pat. No. 6,138,860 to Comeaux, are inventions which may enable the use of stemware. These particular devices did not adequately address the high center of gravity inherent with a pedestal mounted object. Because these devices do not appropriately enable the lowering of the center of gravity of a pedestal mounted object, these devices may be unstable and may not adequately allow free movement for the operator.

Others, namely, U.S. Pat. No. D 194,114 to Graham, U.S. Pat. No. D 227,851 to Nowland, U.S. Pat. No. D 270,324 to French, U.S. Pat. No. D 281,565 to Stourton et al, U.S. Pat. No. D 322,197 to Sherlin, U.S. Pat. No. D 331,860 to Stanfield, U.S. Pat. No. D 373,052 to Di Biase, U.S. Pat. No. D 388,661 to Vignau et al, U.S. Pat. No. D 392,156 to Michael, U.S. Pat. 4,516,685 to French, U.S. Pat. No. 4,607,758 to Stevens, U.S. Pat. NO. 4,961,555 to Egan, Jr., U.S. Pat. No. 5,085,391 to Berger et al, U.S. Pat. No. 5,111,960 to Zilliox, (subsequent U.S. Pat. No. Re. 34,703 to Zilliox), U.S. Pat. No. 5,114,038 to Laumann geb. Quensen, U.S. Pat. No. 5,234,125 to Roberts, U.S. Pat. No. 5,361,932 to Friedrich, U.S. Pat. No. 5,397,089 to Kataoka, U.S. Pat. No. 5,419,455 to Russeau, U.S. Pat. No. 5,542,577 to Friedrich, and U.S. Pat. No. 5,950,856 to Cinque appear to have somewhat attempted to address stemware stability by lowering the stemware's center of gravity to the surface level of their inventions. All of these inventions possess an opening in the outer perimeter creating an access point which may be intended for the passage of a stemware stem. The inventions have a perimeter resting location in which the beverage container element of the pedestal mounted object may be seated in the perimeter of the invention.

Further, an open passage way may result in a plate-device with a broken circular perimeter. In certain non-horizontal positions, stemware could unintentionally unseat and fall from the device. Additionally, a perimeter stemware resting point may place undue weight in a location that causes non-desirable leverage and strain on the hand, wrist and arm of the operator. In U.S. Pat. Nos. 5,624,052 and 5,732,847 to Caldi, the center of gravity of a stemware object was lowered to the surface of the invention and placed the resting point in the middle. However, these patents are flawed because they may have a broken circular perimeter for the passage of the stemware stem.

Wherever people gather to enjoy food, beverage and socializing there is a need for a simple and economical device that lends greater manual dexterity to the attendees.

IV. DISCLOSURE OF THE INVENTION

In embodiments, the invention may include a holder element where the operator can grasp a device with one hand while maintaining a stable surface and minimizing the stress on the hand, wrist, and forearm. At the sacrifice of surface area, an embodiment of the device may even possess a negative space which may be elliptical and even large, for the passage of the thumb beyond the second knuckle. Therefore, in one embodiment of the present invention the operator's thumb may pass through a horizontal plane of the device beyond the second knuckle and may be then incorporated into the device. This embodiment may be particularly unique because of the increased comfort and stability that results.

The negative space, as presented in the drawings and referred to in the specification, may enable the passage of an average size human thumb between the lower surface and upper surface of the invention. This may enable the operator to balance portions of the weight of the invention on three (3) primary contact points: 1) the lower surface of the concave elliptical negative space rests on the heel of the hand, 2) the lower surface of the invention rests on the remaining digits of the same hand, 3) the lower surface of the invention perimeter between an elliptical negative space and the operator rests on the wrist of the same hand. A negative space may also enable hanging of multiple stacked and packaged units for storage and retail display.

In other embodiments, a relatively large ovular negative space perhaps even a thumb hole placed near the perimeter of the planar support may enable the comfortable resting of the plate on the heel of one hand with placement of the human thumb on the upper surface and remaining digits supporting the lower surface. Thus, the thumb may be placed through an ovular thumb hole of an upper surface allowing the partial passage and resting of the plate on the heel of the average sized hand. Fingers (digits) underneath the lower surface may provide stability for the invention. In addition, the large ovular thumb hole or an elliptical negative space can be used without modification to the embodiment, to enable the hanging of the invention on a bracket for retail sales display.

Further, in embodiments, the invention may include the aspect in which objects of varying size and shape, such as cylindrical, can be seated in the center of a horizontal device. The central seating of such an object may allow the operator to maximize balance characteristics of the invention while supporting an object of height and weight that exceed the height and weight of the horizontal device being used as a support platform. Hence, an embodiment of the present invention may include a balance element centrally located in the device which may provide enhanced balance to the operator while supporting an object. This balance element can be a centrally recessed area which may enable balanced retention of a beverage container such as, but not limiting to, mugs, tumblers, cans and bottles.

Another embodiment of the present invention may provide a system for the base and stein of a pedestal mounted object to pass through the horizontal plane of the device and rest or seat the stemware globe of such a pedestal mounted object toward the center of the invention. Therefore, an-embodiment of the device may include a stem base insertion element and a stemware globe holder element such as for a pedestal mounted object. The stem based insertion element and stemware globe holder element may even function to lower the center of gravity of the pedestal mounted object to the horizontal plane of the device providing significant stability and adding to the mobile ability of the operator.

Further, there are steps that can be used in order to incorporate a pedestal mounted object or stemware into one embodiment of the present invention. Generally, the operator may use any combination of the following five movements in order for the stemware to reach the balanced rest point: 1) perhaps while holding the globe of the stemware, the operator may place the base of the stemware near the containment structure, 2) the operator may horizontally slide the entire stemware toward the outer perimeter, perhaps allowing the stem to progress into a stem void portion, 3) the operator may vertically descend the stemware until the base of the stemware is sufficiently below the lower surface of the device, 4) the operator may horizontally slide the entire stemware toward the hand of the operator, perhaps allowing the stem of the stemware to pass through even a keyhole shaped cutaway or yawning void, and 5) the operator may allow the globe portion of the stemware to descend and seat in the round portion of the bottom surface keyhole where it may be now safe to release the globe of the stemware. In order to remove the stemware from this centrally balanced resting place, the operator may reverse the five step process detailed above. While five steps have been described, this is not meant to limit to a specific number of steps needed to incorporate a pedestal mounted object or stemware with the present invention.

In addition to the accommodation of a cylindrical or pedestal mounted object, another embodiment of the invention may provide remaining space on the horizontal surface for the placement and retention of secondary items. Therefore, embodiments of the present invention may provide a retention element or elements for secondary items. While these concave shaped region(s) allow for retention of food, if the device is moved horizontally and/or with some limited vertical tilt motions, the concavity may further retain the secondary items.

Another embodiment of the invention provides the ability to stack and interlock units, thus minimizing storage space and enabling efficient transportation of multiple units. Generally, convex regions of the lower surface of a device may mate with the concave regions of the upper surface of another device to enable stacking and efficient use of space.

The present invention includes a variety of aspects that may be selected in different combinations based upon the particular application or needs to be addressed. Generally, in one embodiment, the invention may allow an operator to single-handedly hold a horizontal device with a lighter and more comfortable grasp. This may allow the operator to increase the load on such horizontal device and maintain a stable surface for longer periods of time with minimal stress on the hand, wrist, and forearm.

The objects of the invention are quite varied due to the differing and potentially independent aspects of the invention. One of the broad objects of the invention may be to allow an operator to single-handedly maneuver a device, which may be primarily horizontal in shape with less strain and increased stability: Thus, one goal may include achieving a comfortable position for the hand, wrist and arm of an operator that may be ergonomically efficient. Further, beyond a comfortable position, a method of minimizing the muscular strain normally associated with grasping a horizontal device may be achieved.

Another broad goal of the invention may be to provide secure placement of a container or even a cylindrical object on the invention so the operator can maneuver both items with just one hand. Essentially any reasonably sized object, consumable or non-consumable, can be rested on the top surface of the invention. Thus, one goal may involve a balance area that can accommodate objects of varying diameter and height, such as cylindrical objects.

Yet another goal may be to seat the base of a cylindrical object low enough in the horizontal device to maximize stability. A related goal may be to provide a structure that may be low enough while maintaining a profile of the horizontal device that may be aesthetically pleasing and socially regarded with plate-like appearance.

Another goal of the invention may be to accommodate a pedestal mounted object. Thus, one goal may be to enable the base and stem of a pedestal mounted object to pass through the plane of the horizontal device, subsequently lowering the center of gravity. Further, one goal may be to enable the base and stem of a pedestal mounted object to pass through the plane of the horizontal device without creating an open outer perimeter. In an embodiment, a containment structure may enable the passage of a stemware base through the horizontal surface of the plate with the globe of the stemware ultimately balanced in a central structure of the plate.

A related goal may be to provide a final balance point in the most central location of the device, contributing to stability. More specifically, the balance element may provide stability when the surface of the device may be tilted to reasonable degrees. For example, when beverage containers and stemware with sociable amounts of liquid, such as three quarters (¾) full, are seated in the final balance region, they may retain liquid and remain in place when the surface of the device may be tilted to reasonable degrees.

An additional broad goal of the invention may be to provide for the retention of secondary items on the remaining space of the horizontal surface. This may translate into a sub-goal of creating region(s) of concavity.

The invention may also include the goal of stacking the invention to provide for storage and shipment that consumes less volume than devices which are non-integrating. This may result in a goal of creating degrees of shapes and concavity that enable the lower surface of the invention to mate with the upper surface of a duplicate copy of the invention.

Another broad goal may be to allow the invention to be efficiently displayed in a retail sales environment. This may result in a goal of showcasing the invention with a top surface view in order to draw attention to the unique design characteristics.

A goal of the invention may also be to provide a device that is economical, disposable and even non-disposable. Another goal may be to use a material and manufacturing technique that is cost efficient.

Naturally, further objects, goals and embodiments of the inventions are disclosed throughout other areas of the specification claims.

V. BRIEF DESCRIPTION OF THE DRAWINGS

FIG. 6A is a representation of movements of a pedestal mounted object of an embodiment of the present invention.

FIG. 6B is a representation of movements of a pedestal mounted object of an embodiment of the present invention.

FIG. 6C is a partial view of movements of a pedestal mounted object of an embodiment of the present invention.

VI. MODE(S) FOR CARRYING OUT THE INVENTION

The present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and embodiments should not be construed to limit the present invention to only the explicitly described systems, techniques, and applications. Further, this description should further be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 1:
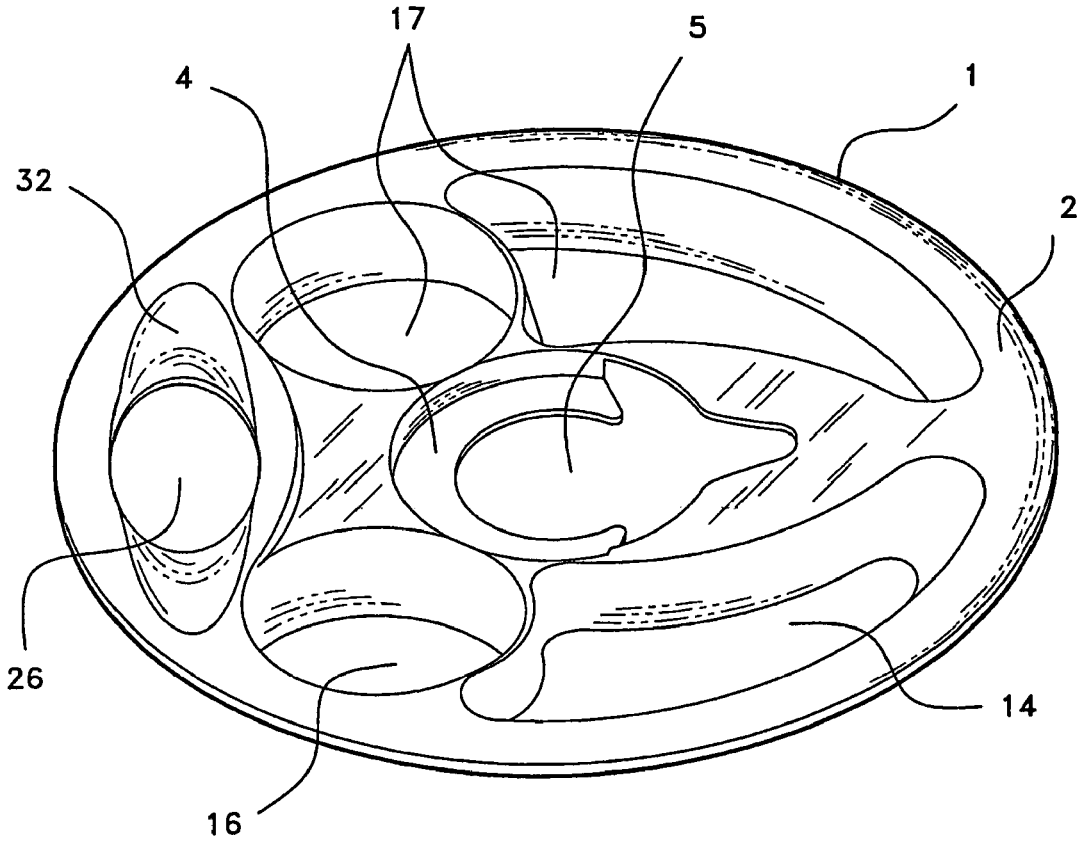
FIG. 1 is a perspective view of the upper surface in an embodiment of the present invention.

To understand the various embodiments of the present invention, figures have been provided. Generally, the present invention includes a free moving plate for use at social gatherings. Typically a plate comprises a horizontal planar support having an upper surface and a lower surface. The upper surface can provide support for food and drink items. In embodiments, the invention may include an integral somewhat planar support (1) as shown in FIG. 1. The integral somewhat planar support (1) may include several parts or components some planar and even some non-planar parts such as a region (14) or perhaps even a containment structure. A region may be included and may provide concavity to the integral somewhat planar support.

FIG. 1 shows the view of an upper surface (2) of an integral somewhat planar support (1). While the upper surface can be almost planar or flat, it is conceptually shown in an embodiment that the upper surface may include at least one region (14). Of course any number of regions may be provided. In an embodiment, four regions are shown in FIG. 1. The regions may provide for food or drink retention regions. In an embodiment, the present invention may include at least one food holder (17) and at least one beverage holder (16). As but one example, the beverage holder may provide for drink items such as a can, a bottle, a glass, a cup, a mug, tumbler, or like items. Functionally, some of the holders may be used for either food or beverages.

In embodiments, the present invention may include any kind of shaped planar support. For example, but not limited to, the planar support may be circular, rectangular, curved, or any type of shape. The figures include a circular shaped planar support, but this disclosure is not meant to be limiting and should include any type of shaped planar support.

Figure 2:
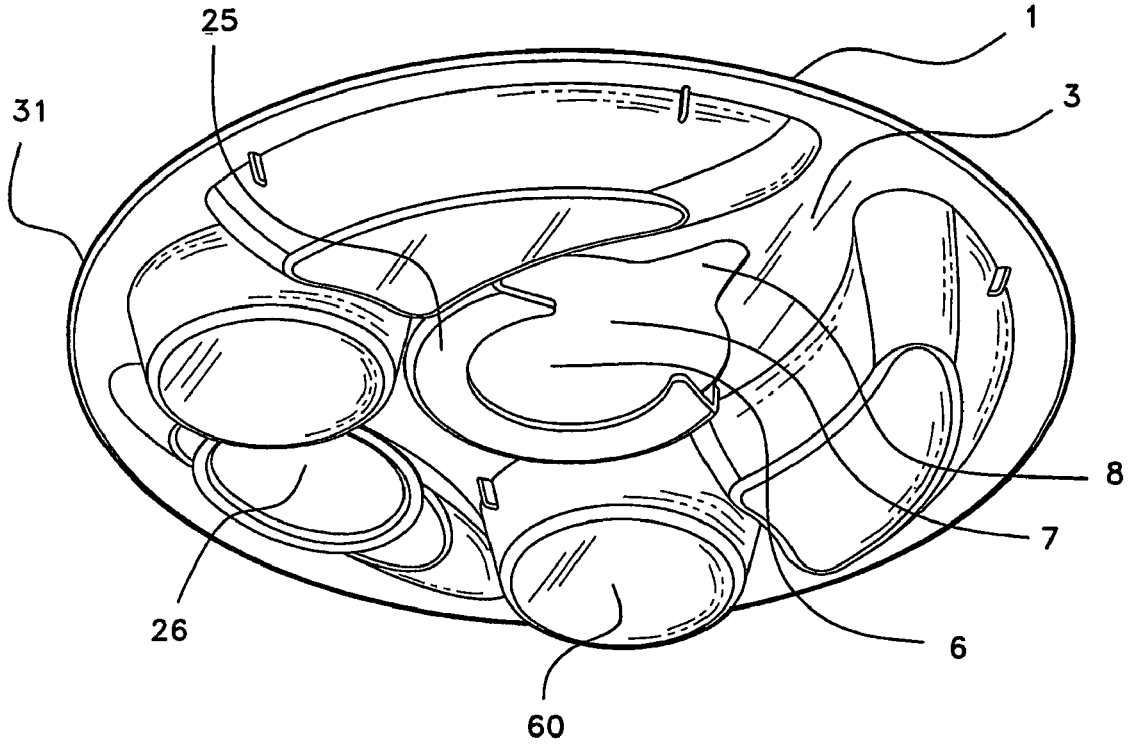
FIG. 2 is a perspective view of the lower surface in an embodiment of the present invention.

In embodiments, the free moving plate may also include a containment structure (4) specifically for placing a beverage. The containment structure may act to contain all types of containers and may consist of an arrangement of multiple parts. For example, such containment structure may accommodate a can, bottle, glass, cup, mug, tumbler, a pedestal mounted object, a wine glass, or any of the like containers. In embodiments, a containment structure may include an inner surface that defines a fully surrounded yawning void, as seen in FIGS. 1 and 2. A yawning void may provide a wide open hole in the containment structure and may be enclosed from the outer perimeter of the integral somewhat planar support. As illustrated in FIG. 1, the yawning void does not have any openings to the outside perimeter of the integral somewhat planar support. An embodiment may include centrally locating a containment structure within an integral somewhat planar support. This may provide for structural stability of a planar support as well as comfort for the user. While this embodiment is shown in the figures, it is not meant to limit the placement of a containment structure. The containment structure may be located at any non-central location of the somewhat planar support in other embodiments.

In other embodiments, the present invention may include a noncircular yawning void where a yawning void (5) does not define a complete circular shape. A complete circular shape may include a partially surrounded void that has a circular shape with an opening or gap in the perimeter of the void. While the yawning void (5) can be almost any noncircular shape, it is conceptually shown in FIGS. 1 and 2 with a keyhole-type shape. Naturally, this is not to be construed as a limit to the invention, but rather a conceptual aide in understanding an embodiment of the invention.

Figure 3:
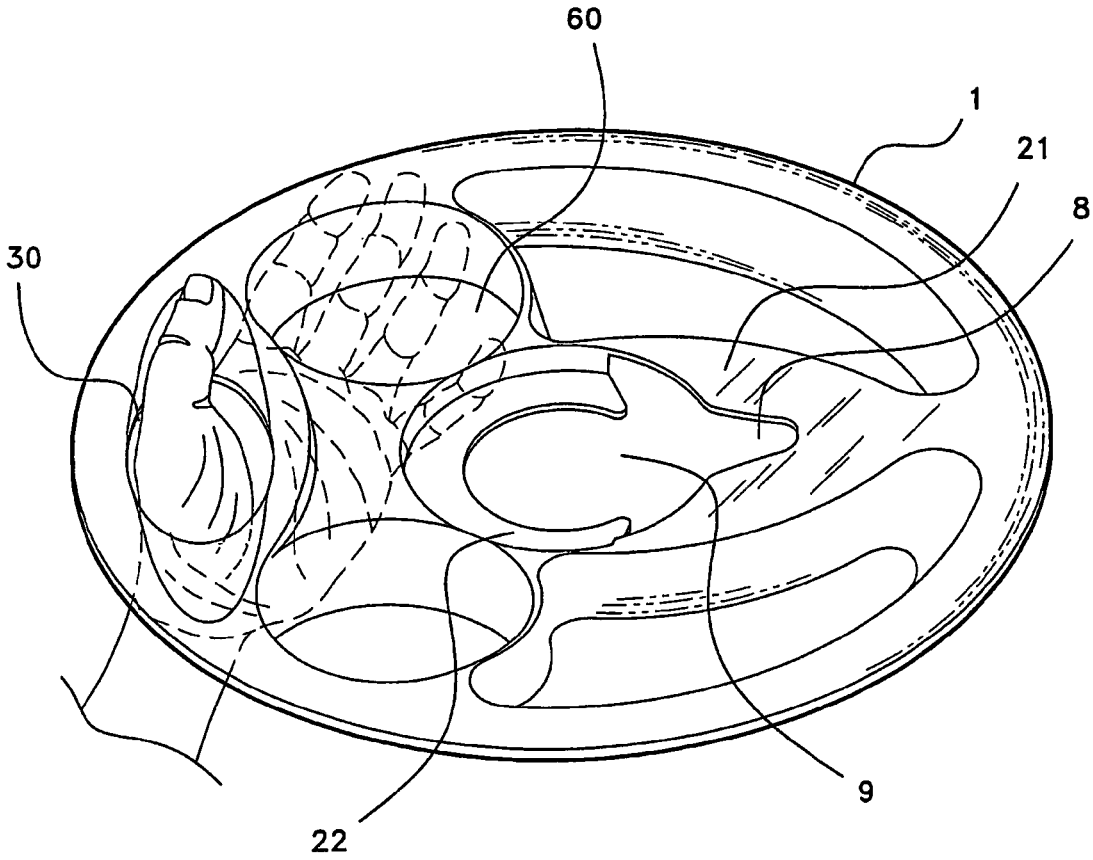
FIG. 3 is a perspective view of the upper surface of an embodiment of the present invention, illustrating the hand of a user.

To provide a lower center of gravity, a containment structure may include but is not limited to multiple levels or a tiered region or may even have a split level. Referring to FIG. 3, it can be understood that a split level containment structure may include a first level (21) and a second level (22) wherein the second level may provide the support for a container. Of course, any number of levels may be incorporated to properly seat and stabilize a container.

In other embodiments the second level may include a tiered circular region. A second level may be for the retention of a container, perhaps a cylindrical object or even the upper portion of a pedestal mounted object. In embodiments, concentric steps of a tiered circular region of decreasing size arranged on central axis within the tiered circular region may enable the seating and movement minimization of a cylindrical object or upper portion of a pedestal mounted object.

Certainly in the context of supporting a pedestal mounted object or stemware on an integral somewhat planar support, it should be understood that the containment structure or perhaps the yawning void could be especially configured to receive a container (10) that has a globe (11), a stem (12) and a base (13). As such, the containment structure may be specifically structured to support a pedestal mounted object while providing stability and a lower center of gravity. In an embodiment, the present invention may provide for the stem (12) and base (13) of a container to move through the somewhat planar support which may provide moving the stem and base of a container in at one surface of the planar support and out the other surface. The globe (11) of the container may be seated on at least part of the containment structure and may even be seated on a globe seat (25) allowing the stem and base to hang below the lower surface of an integral somewhat planar support. To accomplish this and as illustrated in FIGS. 2 and 3, the yawning void (5) may include portions of which accommodate different parts of the stemware.

In an embodiment, a globe void portion (6) may have an opening width less than the width of a globe (11). The globe void portion may allow a lower part of the globe to fit through the globe void portion while preventing an upper part of the globe or even the largest width of a globe from fitting through the globe void portion. This can be understood in FIGS. 5A and 5B that show part of a globe (11) that fits through the globe void portion and part that does not. Specifically, the globe of a container may be positioned proximate to an upper surface of the somewhat planar support where the globe may be positioned near the globe void portion. Then the globe may be seated on at least part of the containment structure where a portion of the globe passes though the globe void portion. The globe void portion width selected may represent any width that is less than the largest width of any globe. Such possibilities may include:

less than about 9.0 cm,
less than about 8.5 cm,
less than about 7.4 cm,
less than about 6.0 cm,
less than about 5.8 cm,
less than about 5.6 cm,
less than about 5.4 cm, and
less than about 5.2 cm.

Other widths are certainly possible and all should be understood as represented within the scope of this invention.

In other embodiments, the present invention may include a base void portion (7) which has an opening width greater than a width of the base of a container to allow the base (13) of the container to pass through the somewhat planar support. This is illustrated in FIGS. 2 and 6A and may provide for moving the base through the base void portion. The base void portion width selected may represent any width that is greater than the largest width of any base. Such possibilities may include:

greater than about 5.5 cm,
greater than about 6.0 cm,
greater than about 7.2 cm,
greater than about 7.8 cm,
greater than about 8.2 cm,
greater than about 9.0 cm and,
greater than about 9.5 cm.

Other widths are certainly possible and all should be understood as represented within the scope of this invention.

Alternatively, the present invention may provide for a stem void portion (8) which has an opening width greater than the width of a stem of a container that will allow passage of at least part of a stem (12) through part of the containment structure. The stem void portion width selected may represent any width that is greater than a width of any part of a stem. Such possibilities may include:

greater than about 0.8 cm,
greater than about 1.0 cm,
greater than about 1.2 cm,
greater than about 1.8 cm, and
greater than about 2.4 cm.

Other widths are certainly possible and all should be understood as represented within the scope of this invention.

In yet other embodiments, the present invention may include a contracted globe void portion (9) which has an opening width that is substantially less than the width of a globe of a container. The contracted globe void portion may aid in the secure containment of the globe. The contracted globe void portion width may represent any width that is substantially less than a width of the largest part of a globe. The contracted globe void portion width selected may represent any width that is less than a width of a globe void portion, as described above. Such possibilities may include:

less than about 6.0 cm,
less than about 5.5 cm,
less than about 5.0 cm,
less than about 4.6 cm,
less than about 4.2 cm, and
less than about 4.0 cm.

Again other widths are certainly possible and all should be understood as represented within the scope of this invention.

Each of the yawning void portions described are illustrated in FIGS. 2 and 3. Naturally, this is not to be construed as limiting the invention to include all of the described void portions. Other embodiments may include one or some of the various void portions.

One aspect of the present invention is to provide a container support that allows a user to place and remove containers and even stemware with ease and without spilling the contents in the containers. An embodiment of the invention may include a non-tilt containment structure which may provide for a substantially vertical container and even maintaining a substantially vertical status of the container. By substantially vertical, it should be understood that some minimal tilt or slanting of the container may occur while moving the container in and out of the containment structure and may even occur while the container is seated due to the free moving nature of the somewhat planar support. The somewhat planar support may also maintain a substantially horizontal status during the placement and removal of a container such as stemware. By substantially horizontal, it should be understood that some minimal tilt or slanting of the planar support may occur during the seating and removal of a container with the containment structure and due to the free moving nature of the invention, as also mentioned above.

An embodiment may include a negative space (26) as shown in FIGS. 1, 2 and 3 which may allow a user's thumb to move through a negative space (26). While the negative space may include a variety of shapes, one embodiment may include an elliptical shaped negative space. The negative space (26) may enable ambidextrous use of the device. Thus, in an embodiment, the symmetrical format of the invention may allow for both left and right-handed usage. The negative space may enable the passage of a human thumb through the lower surface to the upper surface of the invention. As such, this may include positioning a hand proximate or near the lower surface of the planar support, placing the hand near a negative space, moving a thumb through the negative space, and grasping the planar support with that hand. To provide proper placement and comfort for a user, the present invention may include a thumb rest (32) where the thumb may be rested when holding the integral somewhat planar support, as shown in FIGS. 1 and 3. In embodiments, a user may place their thumb in a thumb rest where a side of a knuckle of the thumb rests in a thumb rest (32). When holding the planar support, the user may apply force on the planar support with a thumb. This may contribute to balancing the planar support and may even include frictionally balancing the planar support due to the interaction between the thumb and the upper surface of the planar support.

In one embodiment and illustrated in FIG. 3, the present invention may provide for a largely tangential thumb positioner (30) located proximate to a perimeter (31) of the integral somewhat planar support (1). By largely tangentially positioning a thumb, it is understood that when a user holds a planar support, their thumb may be positioned almost tangentially to the outer curve of the planar support as shown in FIG. 3. A tangent may include a line or a plane that touches a curve or a surface at a point so that it may be closer to the curve in the vicinity of the point than any other line or plane drawn through the point.

Therefore, independent aspects of the invention may include:

A free moving plate comprising:

an integral somewhat planar support having an upper and lower surface;

a negative space; and a largely tangential thumb positioner located proximate to a perimeter of said integral somewhat planar support.

A free moving plate system comprising the steps of:

positioning a hand proximate to a lower surface of an integral somewhat planar support;

moving a thumb of said hand through a negative space of said integral somewhat planar support;

grasping said planar support with said hand;

largely tangentially positioning said thumb proximate to a perimeter of said integral somewhat planar support;

supporting said planar support with said hand; and balancing said planar support with said hand.

In embodiments, a thumb may be positioned proximate to the perimeter of a planar support. A thumb position distance may represent any distance from the outer edge of a planar support to a thumb. In embodiments, such thumb position distance which may be measured from any part of the thumb to the perimeter of the planar support may include:

less than about 6.0 cm from the perimeter;

less than about 5.0 cm from the perimeter;

less than about 4.0 cm from the perimeter;

less than about 3.0 cm from the perimeter; and less than about 2.0 cm from the perimeter.

Other distances are certainly possible and all should be understood as represented within the scope of this invention. Of course, a negative space may be placed on any part of a planar support and a user may decide to hold and position their thumb in any number of ways. In embodiments a largely tangential thumb positioner may include an elliptical negative space and perhaps even a thumb rest.

The relatively large hole and the elliptical shape may allow a variety of hand sizes, such as but not limited to small to slightly above average size, to pass either a left or right thumb perhaps beyond the metacarpophalangeal (MCP) joint to a point where the basal joint may be visible above the upper surface of the device. Accordingly, an embodiment of the present invention may provide for a metacarpophalangeal negative space which allows the movement of the MCP joint through the negative space. This may enable the operator to balance and support portions of the weight of the somewhat planar support on a user's hands and may even allow supporting the planar support on the wrist, hand and fingers. Specifically, in embodiments this may include supporting a planar support with three primary contact points, the metacarpal bone, the radius, and the phalanges. Further, the lower surface of the somewhat planar support may rest on the operator's wrist and may alleviate hand strain while holding the device.

As a conceptual aid in understanding the hand and thumb placement, FIG. 3 shows an embodiment of the present invention. Naturally, each user could grasp and hold the device in their own way, thus the illustrations are merely representations of one of the many embodiments of holding the device. Slight supination of the hand, wrist, and arm may be enabled by the elliptical negative space of relatively significant size. This supination may be noticed in FIG. 3.

In some embodiments, a containment structure may be comprised of an upper surface horizontal plane with a keyhole shape cutaway or perhaps even a yawning void. The keyhole cutaway may possess an upper surface keyhole outermost point, and upper surface keyhole taper opening into a tiered circular region. Directly beneath the upper surface horizontal plane may be a channel of negative space. The lower surface may include another keyhole shape cutaway possessing a lower surface keyhole taper progressing into the lower surface keyhole innermost circle. The keyhole cutaway shape of the lower surface may be positioned at a maximum vertical distance from the upper surface horizontal plane while maintaining a socially acceptable profile for the device. The keyhole shape of the upper surface may include an upper surface keyhole taper and upper surface keyhole outermost point may be horizontally opposed with the lower surface keyhole taper and lower surface keyhole innermost circle.

Figure 4A:
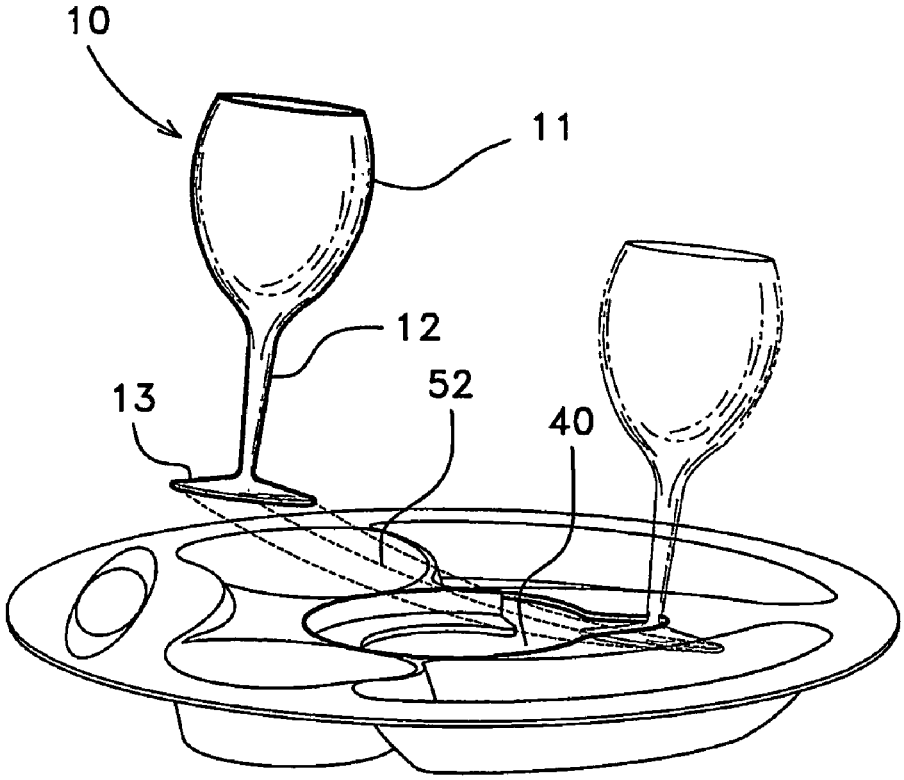
FIG. 4A is a representation of the movement of a pedestal mounted object of an embodiment of the present invention.
Figure 4B:
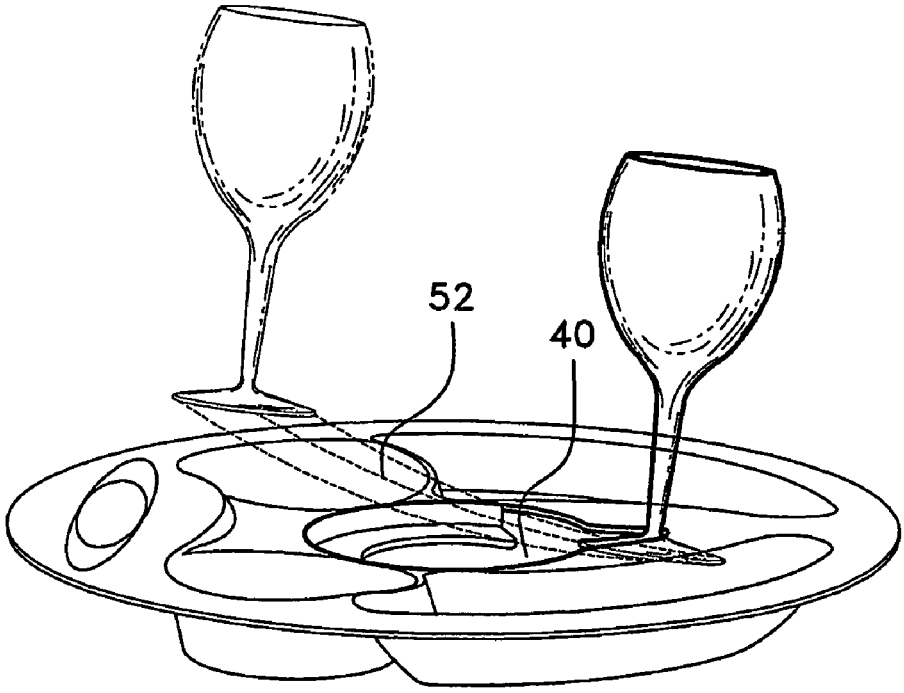
FIG. 4B is a representation of a movement of a pedestal mounted object of an embodiment of the present invention.

An aspect of the invention may include certain movements of a container which move the container through a containment structure. A number of different options may be used to move stemware in and out of the containment structure and the examples presented in this disclosure are not meant to limit the number of movements or how a user may use the present invention. Of course, each individual user may personalize their use of the present invention. An embodiment of the invention may be illustrated in FIGS. 4A, 4B, 5A and 5B. The present invention may include moving at least part of a container in a first directional void (40) which facilitates a first directional movement (52). A first directional movement may be used either to begin the insertion process of stemware into a containment structure, as can be seen in FIG. 4A or to remove a container from the containment structure, as can be seen in FIG. 4B.

Figure 5A:
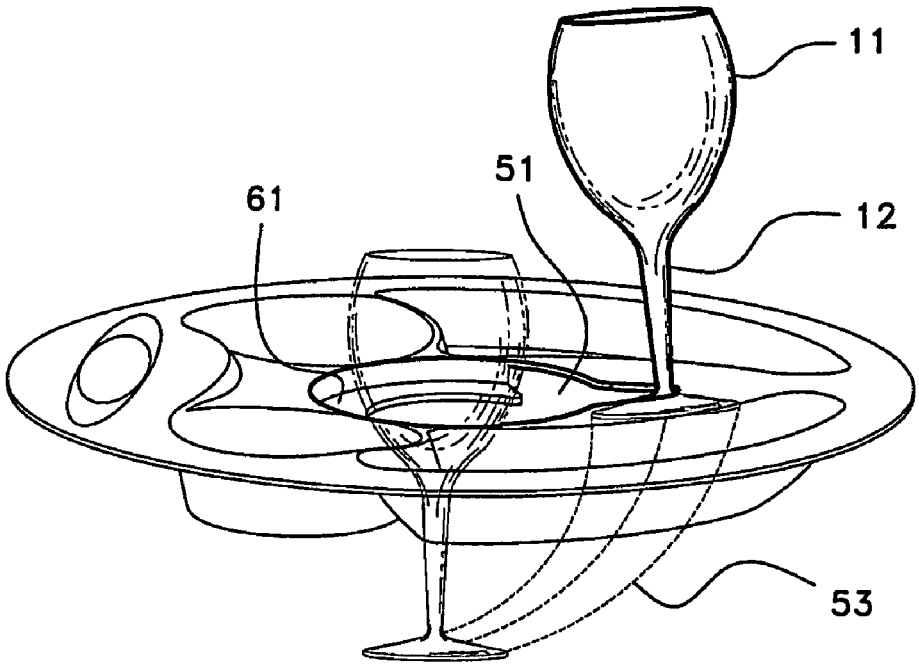
FIG. 5A is a representation of a movement of a pedestal mounted object of an embodiment of the present invention.
Figure 5B:
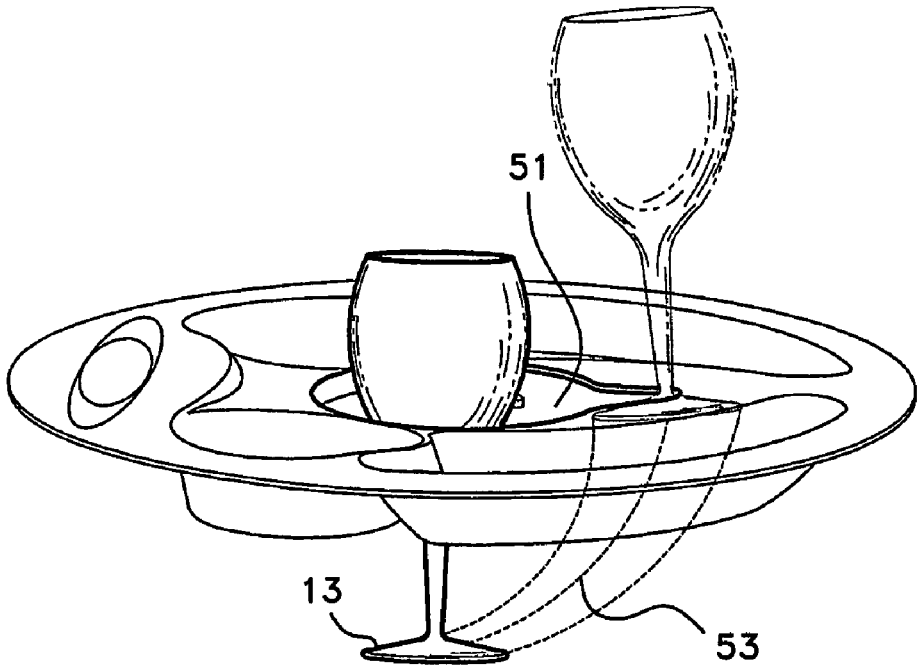
FIG. 5B is a representation of a movement of a pedestal mounted object of an embodiment of the present invention.

A second overlapping antithetical directional void portion (51) may be provided which may facilitate an overlapping antithetical second directional movement (53), as illustrated in FIGS. 5A and 5B. The overlapping antithetical second directional movement may include a movement that may be opposite in direction from a first directional movement and extends over at least a portion of the first directional movement. It may be understood that the second directional movement may not extend over the entire first directional movement because the container may be moved in either a partially upright direction for removal of a container from the containment structure or in a partially downward direction for seating of the container in the containment structure.

Therefore, independent aspects of the invention may include:

A free moving plate comprising a first directional void portion which facilitates a first directional movement and a second overlapping antithetical directional void portion which facilitates an overlapping antithetical second directional movement at least a portion of which overlaps said first directional movement.

A free moving plate system comprising the steps of:

moving at least part of said container in a first directional movement;

moving said at least part of said container in a second directional movement; and overlapping at least part of said first directional movement with said second directional movement in an antithetical direction.

In embodiments, the first directional movement may include movement of abase of a container through a base void portion. In other embodiments the first directional movement may include movement of a stem through a stem void portion (8). A second directional movement may include moving a container away from a stem and a base void portion. It is noted that an embodiment may not include a stem void portion and as such the second directional movement may include moving away from the base void portion. Any of these movements may be accomplished by rotational movement from the wrist of a user's hand.

In other embodiments, the present invention may provide for a multi-directional void portion which may facilitate multiple directional movements which may include any number of movements. Suitably, the operator could use a number of steps to incorporate a stemware or container to a planar support. For example, about a five-step process or about five directional movements can be used to insert or to remove stemware from a planar support. For illustrative purposes FIGS. 6A, 6B and 6C have been provided. Again, this example is not meant to be limiting, therefore any number of movements or steps could be used as each individual user could determine how best to maneuver the container through the containment structure.

In embodiments, an operator may hold the planar support with the aid of a negative space (26) in one hand and a container (10) in the other hand. It may be from this neutral point that the operator could initiate a five step process. As shown in FIGS. 6A and 6B, to place a container in a containment structure, the present invention may include the steps of moving a container towards a containment structure in a first substantially downward vertical direction (54) in which a base maybe lightly touching or perhaps just above a second level of a containment structure. The purpose of this step may be to lower the stemware base to a level where horizontal passage will be possible. Further, embodiments may include the steps of moving a base and a stem of a container through a base and stem void portion of said containment structure in a first substantially horizontal direction (55) which may move the container toward a perimeter of the planar support; moving a container in a second substantially downward vertical direction (56) so a base may protrude beyond a lower surface of the planar support and the globe may be near or perhaps even actually touching the upper surface of the planar support; moving a globe of a container in a second overlapping antithetical substantially horizontal direction (57) proximate to a globe seat; and seating a globe of a container on a globe seat in a third substantially downward vertical direction (58). By a substantial direction, it is meant to be understood that the movements are mostly horizontal or vertical. Depending on the user these movements may vary.

To remove the pedestal container from the planar support, the steps stated above could be reversed. In an embodiment, the removal of a container may include the steps of grasping a part of a globe of a container with a hand; removing a container from a seated position in, a substantially upright vertical direction; moving a container through a stem void portion of a containment structure in a first substantially horizontal direction; moving a container in a substantially upright vertical direction; moving a stem and base through a stem and a base void portion of a containment structure in a second overlapping antithetical substantially horizontal direction; and removing a container from a containment structure in a substantially upright vertical direction.

FIG. 6C shows an embodiment of the invention which includes the placement of the base of a container during the five step process. Placement (a) shows the placement of a base of a container when it may be near a containment structure. Placement (b) shows the placement of a base of a container after a first substantially downward vertical direction (54). Placement (c) shows the placement of a base of a container after a first substantially horizontal direction (55). Placement (d) shows the placement of abase of a container after a second substantially downward vertical direction (56). Placement (e) shows the placement of a base of a container after a second overlapping antithetical substantially horizontal direction (57). Placement (f) shows a placement of a base of a container after a third substantially downward vertical direction (58). Of course, if reversed, FIG. 6C also shows an embodiment of the placement of a stem of a container as it may be removed from a containment structure.

A user may desire to place a planar support which may contain stemware without having to remove the stemware from a containment structure. When stemware is located in a containment structure, the present invention, in embodiments, may provide steps to place a planar support onto a table surface or any type of planar surface. These steps may include lowering the planar support above a table surface, holding at least part of a globe while lowering the planar support, allowing the base to touch a table surface, and lowering the planar support until the planar support touches the table surface. These steps may be reversed to remove a planar support containing stemware from a table surface.

In embodiments, the shape and contours of the inner surface of a containment structure may ease and perhaps even guide the passage of a container to each of the void portions. These shapes and contours may perhaps even enable the operator to perform certain steps without the aid of vision.

FIG. 5B includes a seated stemware in a bowl seat of a containment structure. At this point, the operator has released one hand and may be able to hold the device and the stemware with just one hand perhaps while engaging an elliptical negative space.

In order to provide comfort and stability, the present invention may include a positive element (60) located in a lower surface (3) of an integral somewhat planar support (1). A positive element may include a structure which may be characterized by the presence of certain qualities or features. In embodiments, such positive element may include a structure on a lower surface in which a user can hold or grip while supporting a planar support. This may include any contour of a lower surface. In other embodiments, a positive element may include a non-friction element. Without a positive element, a user may rely on friction between a user's hand and fingers and a lower surface to support a planar support. A positive element may even include the lower surface of a region as shown in FIG. 2.

Accordingly, independent aspects of the present invention may include:

A free moving plate comprising:

an integral somewhat planar support having an upper and lower surface;

a negative space; and a positive element located on said lower surface of said integral somewhat planar support.

A free moving plate system comprising steps of:

moving a thumb of a hand through a negative space of an integral somewhat planar support;

placing fingers of said hand on a lower surface of said integral somewhat planar support; and holding a positive element with said fingers on said lower surface of said integral somewhat planar support.

When a user holds a planar support, in embodiments, a user may place their fingers on the lower surface for support where the fingers or phalanges may partially bear the weight of the device. To ease in comfort and stability, the present invention may provide for a user to hold a positive element with their fingers or even cup the lower surface where phalanges are curved around a positive element. This may be conceptualized in FIG. 3. Of course each individual will hold the device differently; accordingly, this figure may be merely an example of how a hand and fingers may hold a positive element.

In another aspect, the present invention may provide for stability of a container on a planar support even if the planar support is tipped accidentally. Accordingly, the present invention may include, in embodiments, the maintaining of a substantially vertical status of a container when a planar support may be tipped. As mentioned above, substantially vertical, may include some flexibility of the vertical status of a container. In an embodiment, the present invention may include a primary retainer element and a secondary retainer element. A primary retainer element (61) may include an element where a container may normally be seated when the planar support is in a substantially horizontal status, as shown in FIGS. 5A and 5B. This may include, but is not limited to a globe seat (25). Another embodiment may include a reinforced globe seat (67), as shown in FIG. 7B, where additional support may be provided to prevent the container from tipping over.

Accordingly independent aspects of the present invention may include:

A free moving plate comprising:

an integral somewhat planar support having an upper and lower surface; and a primary retainer element and a secondary retainer element.

A free moving plate system comprising the step of maintaining a substantially vertical status of a container when an integral somewhat planar support is tipped.

Figure 7A:
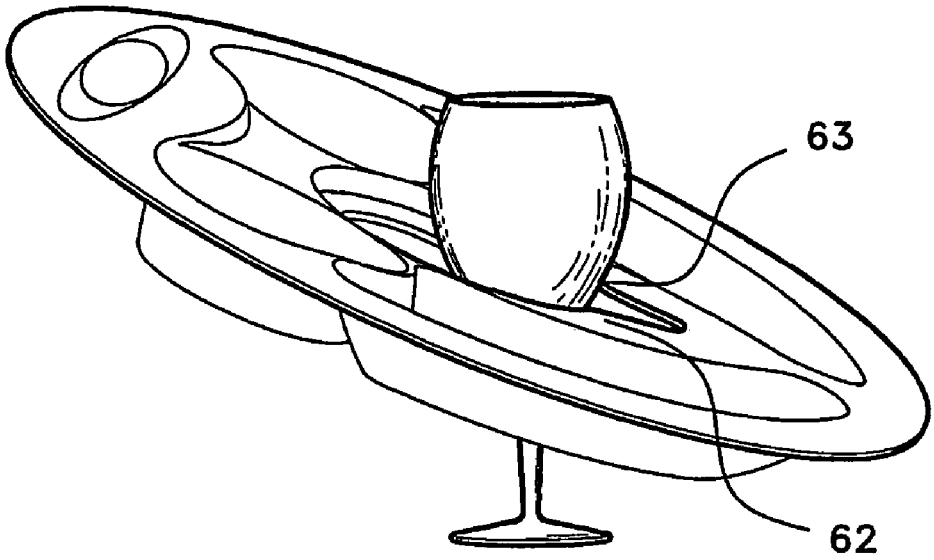
FIG. 7A is a perspective view of an embodiment of the present invention.
Figure 7B:
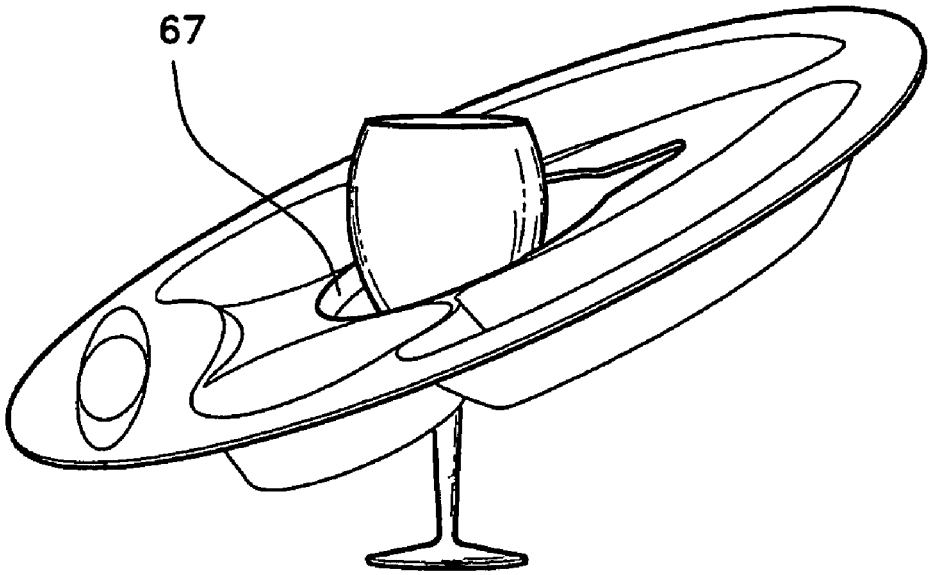
FIG. 7B is a perspective view of an embodiment of the present invention.

As illustrated in FIG. 7A, if a user somehow tilts the planar support in a downward direction, a secondary retainer element (62) may prevent a container from also tipping over. Due to the nature of the present invention, even if a plate is tipped to a reasonable angle, a container may remain substantially vertical. During the tipping of a planar support, a container may move towards a secondary retainer element and contact with the secondary retainer element. Yet, during these movements, the container may remain substantially vertical preventing any contents in the container from spilling. In embodiments, a secondary retainer element (62) may include a separate and distinct element. Where the secondary retainer element may not be part of the primary retainer element, this is not meant to limit the invention.

In other embodiments, the present invention may include an angular vertical retainer element (63). This may include an element that may be placed at an angle above a primary retainer element which may retain and maintain a container at a vertical status when a planar support may be tilted at an angle. While the placement of an angular vertical retainer element may include any angle, an example of some possible angles may include:

less than about a 40 degree angle;
less than about a 35 degree angle;
less than about a 25 degree angle;
less than about a 20 degree angle;
less than about a 15 degree angle;
less than about a 13 degree angle; and
less than about a 10 degree angle.

Other angles are certainly possible and all should be understood as represented within the scope of this invention. The angle may be measured from the upper surface of the primary element to the outer surface of an angular vertical retainer element where a container meets with the angular vertical retainer element.

In some embodiments a negative space (26) as described above, may be located opposite of an angular retainer element, as shown in FIG. 7A. This may include locating an angular retainer element Away from a negative space.

Figure 8A:
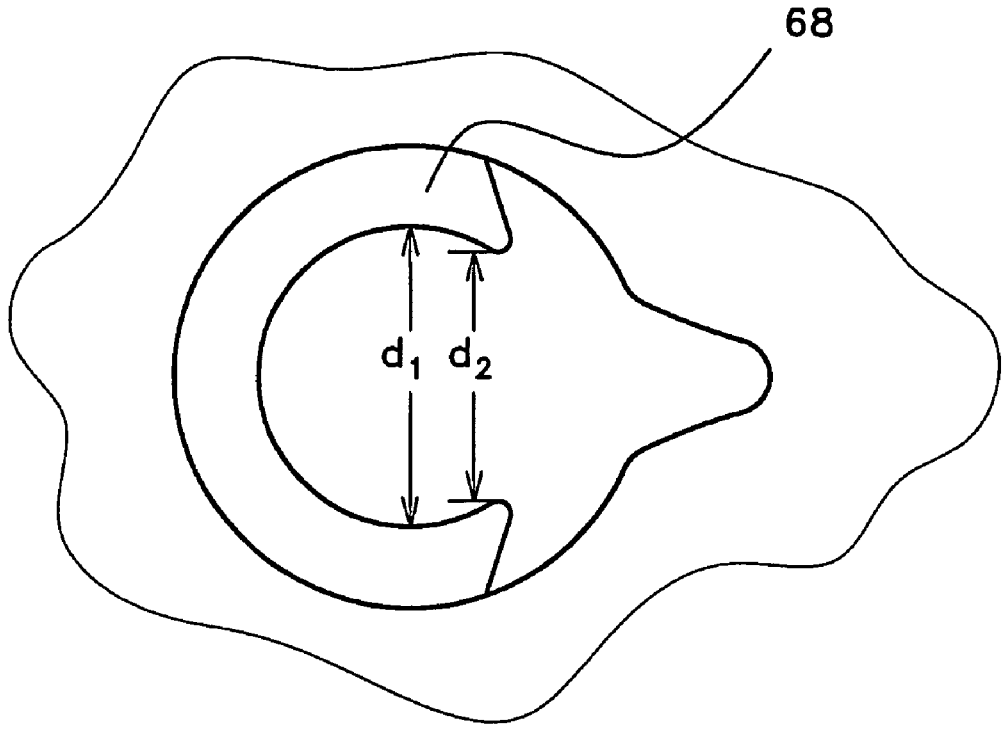
FIG. 8A is a partial view of an embodiment as shown in FIGS. 1, 2 and 3 of the present invention.

In other embodiments, the present invention may include a modestly retained container holder (68), as shown in FIG. 8A. This holder may retain a container in a limited amount while providing sufficient stability and retirement of the container. In some embodiments the modestly retained container holder may include a C-shaped globe seat to hold a globe of a container. A percentage retention value may be derived from a measurement of a first distance ($d_1$) and a measurement of a second distance ($d_2$) as shown in FIG. 8A and may be calculated as follows:

$$\text{percentage retention value}=(1-(d_2/d_1))\times 100$$

Examples of some percentage retention values may include:

about 10%,
about 15%,
about 17%,
about 20%, and
about 25%.

Other values are certainly possible and all should be understood as represented within the scope of this invention. Of course, modestly retained may include any amount of retirement that is less than 100%.

Accordingly, independent aspects of the present invention may include:

A free moving plate comprising:

a containment structure having an inner surface defining a fully surrounded yawning void; and a modestly retained container holder.

A free moving plate system comprising the step of modestly retaining said seated container within a fully surrounded yawning void of a containment structure.

The adaptability of the device with beverage containers of varying configurations and representative food items may be included in embodiments of the present invention. The present invention may provide retention of stemware, tumbler, cup, can, mug, or the like beverage containers. Remarkably, the present invention may allow for retention of these various beverage containers in a containment structure (4) and may even allow retention in a beverage holder (16).

An aspect of the invention may be to provide a device that can be shipped, sold, displayed and the like using optimal space, etc. In embodiments, the present invention may include a stackable integral somewhat planar support which may allow the ability for stacking duplicate copies of the device. The lower surface of a planar support may enable the lower surface of one unit to mate with the upper surface of a duplicate unit. A plurality of associated planar supports may be nested together in a stack of considerable height with virtually no wasted storage space. Minimized storage space improves the economics associated with shipment, storage, and retail sales space.

In an embodiment, the present invention may relate to an additional application of negative space (26) as a means for retail display. A wall bracket can pass through the negative space and the weight of the entire device may be subsequently rested on the same wall bracket. This method of storage as it relates to retail display may be of particular value because the upper surface of the invention may be now visible horizontally. Such a method of display could result in immediate recognition because the unique embodiments are more visible from this angle.

Figure 8B:
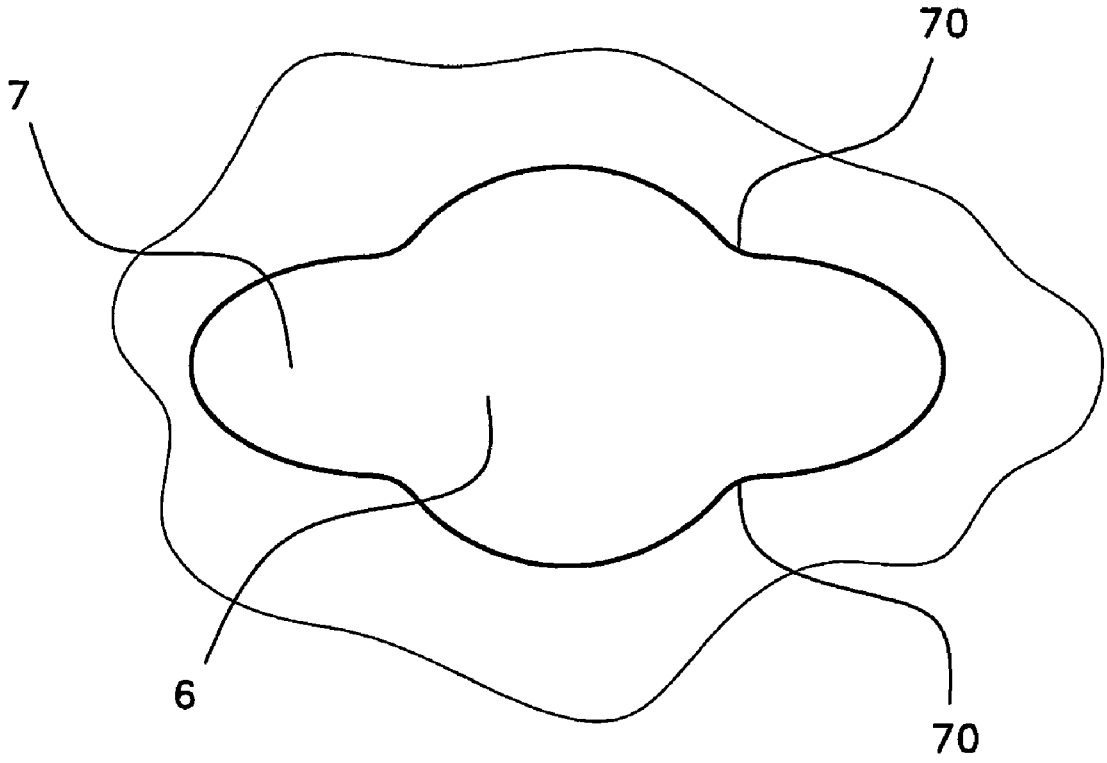
FIG. 8B is a partial view of an alternative embodiment of FIGS. 1, 2 and 3 of the present invention.

In another embodiment, the present invention may include a planar containment structure in which the structure may be substantially planar or mostly level. An example could include a globe void portion with a width less than a globe and a base void portion with a width less than a base, as shown in FIG. 8B. When seating a container in such a structure, the structure may support a container or even a globe of a container at four container support junctures (70). It may be understood that the container support juncture may be the area that the container joins the structure. Of course, other embodiments may include more or less than four container support junctures and may even include varying shapes of a planar structure. In other embodiments, such an example as shown in FIG. 8B may be modified to a multiple level, even a split level structure, or the like.

Independent aspects of the invention may include:

A free moving plate comprising:

a substantially planar support having an upper and lower surface;

a planar containment structure defining a fully surrounded non-circular yawning void;

a globe void portion of said containment structure having a width less than a globe of a container; and a base void portion of said containment structure having a width greater than a base of said container.

A free moving plate system comprising the steps of:

holding a substantially planar support having an upper and lower surface;

positioning a container having a globe and a stem proximate said upper surface of said substantially planar support;

moving a base of said container through a base void portion of a fully surrounded noncircular yawning void of a containment structure having a width greater than said base;

positioning said globe of said container proximate a globe void portion of said fully surrounded noncircular yawning of said containment structure void having a width less than said globe; and seating said globe of said container on at least a portion of said containment structure.

In yet another embodiment, the present invention may provide for a method of composite construction design in which an upper unit may be mated with a lower unit to create one device. The mating of these independent units can be achieved using an appropriate method of bonding, such as thermal, adhesive, or others, perhaps in combination. This method of construction may prove more economically feasible than—but do not eliminate the—techniques of die cutting, thermoforming, milling, pressing, stamping, molding, or injection molding. Such method(s) may be desired to create the independent upper unit and lower unit; however, by laminating two or more units, the process of creating the unique three dimensional shapes of the assembled composite device may prove more economical. The upper unit and lower unit are not intended to be limiting and may each be comprised of one or a multiple of layers to achieve the desired dimensions of the final product. Of course, in other embodiments the present invention may include a one-piece molded planar support, as can be seen in the figures.

The device can be manufactured using any material that maintains a sufficient degree of rigidity, such as plastic or paper. The term plastic may be used as a broad definition, and may include, but is not limited to, injection molding, thermoforming or lamination, employing any rating of recyclable or non-recyclable feed stock. The term paper may be also used as a broad definition, and may include, but is not limited to, corrugated board, formed fibrous material, or laminated paper(s), employing any rating of recyclable or non-recyclable feedstock. Other materials such as metal, wood, glass, and ceramic could be used; however, plastic or paper based products may be better suited for maintaining the integrity of glassware.

As can be easily understood from the foregoing, the basic concepts of the present invention may be embodied in a variety of ways. It involves both general support techniques as well as devices to accomplish the appropriate function. In this application, the support techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure.

Further, each of the various elements of the invention and claims may also be achieved in a variety of manners. Additionally, when used, the term "element" is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "containment structure" should be understood to encompass disclosure of the act of "containing"—whether explicitly discussed or not—and, conversely, were there effectively disclosure of the act of "containing", such a disclosure should be understood to encompass disclosure of a "container" or a "container element" and even a "means for containing." Such changes and alternative terms are to be understood to be explicitly included in the description.

Any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, all references discussed in the application are hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim at least: i) each of the holder and retention devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, and ix) methods and apparatuses substantially as described hereinbefore and with reference to any of the accompanying examples, x) the various combinations and permutations of each of the elements disclosed, and xi) each potentially dependent claim or concept as a dependency on each and every one of the independent claims or concepts presented. In this regard it should be understood that for practical reasons and so as to avoid adding potentially hundreds of claims, the applicant may eventually present claims with initial dependencies only. Support should be understood to exist to the degree required under new matter laws—including but not limited to European Patent Convention Article 123(2) and United States Patent Law 35 U.S.C. § 132 or other such laws—to permit the addition of any of the various dependencies or other elements presented under one independent claim or concept as dependencies or elements under any other independent claim or concept.

In drafting any claims at any time, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Any claims set forth at any time are hereby incorporated by reference as part of this description of the invention, and the applicant expressly reserves the right to use all of or a portion of such incorporated content of such claims as additional description to support any of or all of the claims or any, element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimd is:

1. A free moving food plate for use at social gatherings, comprising:

a one-piece integral somewhat planar support having an upper and lower surface;

a split level containment structure of said one-piece integral somewhat planar support having an inner surface defining a fully surrounded non-circular void especially configured to receive a container having a globe, a stem, and a base with the globe, stem and base configured to be vertically aligned along an alignment axis of the split level containment structure;

wherein said split level containment structure has a top tier opening with a top opening dimension and a bottom tier opening with a bottom opening dimension, and wherein said top opening dimension is greater than said bottom opening dimension, said split level containment structure alignment axis extends through both said top tier opening and said bottom tier opening;

a globe void portion of said split level containment structure configured to have a width less than said globe of said container;

a base void portion of said split level containment structure configured to have a width greater than said base of said container;

a stem void portion of said split level containment structure established above said globe void portion and configured to have a width greater than said stem of said container; and a contracted globe void portion of said split level containment structure configured to have a width substantially less than said globe of said container and to establish an opening into said globe void portion, wherein said stem void portion defines a centroid through which a stem void portion centroid vertical axis passes, wherein said stem void portion centroid vertical axis is outside of said globe void portion, wherein said fully surrounded non-circular void is configured so that retention of said container requires:

(a) a first directional movement of said container so that said stem enters said stem void portion; and (b) a second directional movement of said container so that said globe enters said globe portion, wherein said first directional movement defines a first direction and said second directional movement defines a second direction that is different from said first direction.

2. A free moving food plate for use at social gatherings as described in claim 1 wherein said split level containment structure comprises multiple parts.

3. A free moving food plate for use at social gatherings as described in claim 1 wherein said split level containment structure comprises a first level and a second level.

4. A free moving food plate for use at social gatherings as described in claim 3 wherein said second level is located at a bottom level and comprises a globe seat.

5. A free moving food plate for use at social gatherings as described in claim 1 wherein said split level containment structure comprises four container support junctures.

6. A free moving food plate for use at social gatherings as described in claim 1 wherein said globe void portion of said containment structure having said width less than said globe comprises a width selected from the group consisting of:

less than about 9.0 cm,
less than about 8.5 cm,
less than about 7.4 cm,
less than about 6.0 cm,
less than about 5.8 cm,
less than about 5.6 cm,
less than about 5.4 cm, and
less than about 5.2 cm.

7. A free moving food plate for use at social gatherings as described in claim 1 wherein said base void portion of said containment structure having said width greater than said base comprises a width selected from the group consisting of:

greater than about 5.5 cm,
greater than about 6.0 cm,
greater than about 7.2 cm,
greater than about 7.8 cm,
greater than about 8.2 cm,
greater than about 9.0 cm and
greater than about 9.5 cm.

8. A free moving food plate for use at social gatherings as described in claim 1 wherein said stem void portion of said containment structure having said width greater than said stem comprises a width selected from the group consisting of:

greater than about 0.8 cm,
greater than about 1.0 cm,
greater than about 1.2 cm,
greater than about 1.8 cm, and
greater than about 2.4 cm.

9. A free moving food plate for use at social gatherings as described in claim 1 wherein said contracted globe void portion of said containment structure having said width substantially less than said globe comprises a width selected from the group consisting of:

less than about 6.0 cm,
less than about 5.5 cm,
less than about 5.0 cm,
less than about 4.6 cm,
less than about 4.2 cm, and
less than about 4.0 cm.

10. A free moving food plate for use at social gatherings as described in claim 1 wherein said containment structure comprises a centrally located containment structure on said one-piece integral somewhat planar support.

11. A free moving food plate for use at social gatherings as described in claim 1 and further comprising a container selected from the group consisting of a can, bottle, glass, cup, mug, tumbler and a wine glass.

12. A free moving food plate for use at social gatherings as described in claim 1 wherein said one-piece integral somewhat planar support comprises a stackable integral somewhat planar support.

13. A free moving food plate for use at social gatherings as described in claim 1 and further comprising:

an ambidextrous symmetrical thumbhole; and
a largely tangential thumb positioner located proximate to a perimeter of said one-piece integral somewhat planar support.

14. A free moving food plate for use at social gatherings as described in claim 13 and further comprising a symmetrical thumb rest.

15. A free moving food plate for use at social gatherings as described in claim 14 wherein the symmetrical thumbhole and symmetrical thumb rest each have a central axis of symmetry that is an axis through the center of the thumb hole and the globe void portion.

16. A free moving food plate for use at social gatherings as described in claim 15 wherein the symmetrical thumbhole and symmetrical thumb rest are also symmetric along a transverse axis perpendicular to said axis through the center of the thumb hole and the globe void portion.

17. A free moving food plate for use at social gatherings as described in claim 13 wherein said symmetrical thumbhole enables passage of a thumb beyond the metacarpophalangeal joint.

18. A free moving food plate for use at social gatherings as described in claim 13 wherein said symmetrical thumbhole comprises an elliptical shaped thumbhole.

19. A free moving food plate for use at social gatherings as described in claim 13 wherein said largely tangential thumb positioner located proximate to said perimeter comprises a thumb position distance from said perimeter selected from the group consisting of:

less than about 6.0 cm from the perimeter;
less than about 5.0 cm from the perimeter;
less than about 4.0 cm from the perimeter;
less than about 3.0 cm from the perimeter; and
less than about 2.0 cm from the perimeter.

20. A free moving food plate for use at social gatherings as described in claim 1 wherein said one-piece integral somewhat planar support comprises a symmetrical planar support.

21. A free moving food plate for use at social gatherings as described in claim 1 and further comprising a primary retainer element and a secondary retainer element.

22. A free moving food plate for use at social gatherings as described in claim 21 wherein said secondary retainer element comprises a separate and distinct secondary retainer element from said primary retainer element.

23. A free moving food plate for use at social gatherings as described in claim 21 wherein said secondary retainer element comprises an angular vertical retainer element.

24. A free moving food plate for use at social gatherings as described in claim 23 wherein said angular vertical retainer element is positioned at an angle from said primary retainer element that is selected from the group of angles consisting of:

less than about a 40 degree angle;
less than about a 35 degree angle;
less than about a 25 degree angle;
less than about a 20 degree angle;
less than about a 15 degree angle;
less than about a 13 degree angle; and
less than about a 10 degree angle.

25. A free moving food plate for use at social gatherings as described in claim 21 wherein said primary element comprises a reinforced globe seat.

26. A free moving food plate for use at social gatherings as described in claim 1 wherein said split level containment structure comprises a C-shaped globe seat.

27. A free moving food plate for use at social gatherings as described in claim 26 wherein said C-shaped globe seat comprises a globe percentage retention value selected from the group consisting of:

about 10%,
about 15%, about 17%, about 20%, and about 25%.

28. A free moving food plate for use at social gatherings as described in claim 1 wherein said first directional movement of said container has a first direction horizontal component, said second directional movement of said container has a second direction horizontal component and said first direction horizontal component is opposite said second direction horizontal component.

29. A free moving food plate for use at social gatherings as described in claim 1 wherein said fully surrounded, non-circular void is enclosed from the outer perimeter of the one-piece integral somewhat planar support.

30. A free moving food plate for use at social gatherings as described in claim 1 wherein the distance between said first tier and said second tier is greater than the thickness of the material from which the plate may be constructed.

* * * * *